US006676096B2

(12) United States Patent
Hung

(10) Patent No.: US 6,676,096 B2
(45) Date of Patent: Jan. 13, 2004

(54) AUXILIARY TOOL CLIP OF A JACK

(75) Inventor: Victor Hung, Lu Chu Hsiang (TW)

(73) Assignee: Shinn Fu Corp. (TW)

( * ) Notice: Subject to any disclaimer, the term of this patent is extended or adjusted under 35 U.S.C. 154(b) by 0 days.

(21) Appl. No.: 10/101,592

(22) Filed: Mar. 21, 2002

(65) Prior Publication Data

US 2003/0178542 A1 Sep. 25, 2003

(51) Int. Cl.[7] ..... A47G 1/10

(52) U.S. Cl. ..... 248/316.7; 248/231.81; 248/352

(58) Field of Search ..... 248/352, 351, 248/316.7, 229.16, 229.26, 231.81, 229.1, 218.4, 292.12; 74/546

(56) References Cited

U.S. PATENT DOCUMENTS

| | | | | | |
|---|---|---|---|---|---|
| 1,318,850 | A | * | 10/1919 | Yong | 362/396 |
| 1,349,312 | A | * | 8/1920 | Barrett | 248/214 |
| 2,555,053 | A | * | 5/1951 | Myrick | 248/113 |
| 3,154,281 | A | * | 10/1964 | Frank | 248/201 |
| 4,214,688 | A | * | 7/1980 | Griffin, Jr. | 224/197 |
| 4,220,304 | A | * | 9/1980 | Wong et al. | 248/206.5 |
| 4,390,927 | A | * | 6/1983 | Von Feldt | 362/476 |
| 4,504,001 | A | * | 3/1985 | Nichols | 224/198 |
| 4,678,153 | A | * | 7/1987 | Maddock et al. | 248/229.13 |
| 4,807,395 | A | * | 2/1989 | Kelly | 297/411.38 |
| 4,872,230 | A | * | 10/1989 | Levine | 7/100 |
| 4,919,392 | A | * | 4/1990 | Minuto | 254/126 |
| 4,938,440 | A | * | 7/1990 | Weinfield | 248/183.1 |
| 5,085,384 | A | * | 2/1992 | Kasubke | 248/62 |
| 5,085,407 | A | * | 2/1992 | Lonon | 254/103 |
| 5,118,083 | A | * | 6/1992 | Metzen | 254/126 |
| D333,012 | S | * | 2/1993 | Fleming | D26/138 |
| 5,184,806 | A | * | 2/1993 | Erschens et al. | 254/126 |
| 5,460,346 | A | * | 10/1995 | Hirsch | 248/229.13 |
| 5,577,697 | A | * | 11/1996 | Accordino | 248/206.5 |
| 5,806,146 | A | * | 9/1998 | Chen | 24/3.11 |
| 5,810,311 | A | * | 9/1998 | Davison et al. | 248/316.7 |
| 6,105,940 | A | * | 8/2000 | Charette | 254/423 |
| RE37,111 | E | * | 3/2001 | Barron | 224/268 |
| 6,267,487 | B1 | * | 7/2001 | Tucker et al. | 362/382 |
| D451,007 | S | * | 11/2001 | Jones et al. | D8/395 |

OTHER PUBLICATIONS

Web Brochure http://www.fdp–spywatch.com/hydraulic–floor–jack.htm "FDP Spywatcc–Hydraulic Floor Jack with Storage Case" dated 2000.*

* cited by examiner

*Primary Examiner*—Leslie A. Braun
*Assistant Examiner*—Amy J Sterling
(74) *Attorney, Agent, or Firm*—Bacon & Thomas, PLLC

(57) ABSTRACT

An auxiliary tool clip of a jack. At a predetermined position of a shroud of the jack is installed with a positioning seat. The elastic clip is secured to the positioning seat and the shroud by a positioning shaft. A surface of the positioning seat is distributed with positioning holes. A bottom of the elastic clip is installed with at least one positioning nose. When the positioning nose rotates, the positioning nose moves along the positioning holes on the surface of the positioning seat. The positioning shaft penetrates through the elastic clip, positioning seat and shroud so as to be movably locked. Thereby, an elastic clip is pivotally installed thereon, so that the clip can be used to clip a flashlight, a tire pressure meter or other auxiliary tool and the orientation of the clip is changeable through rotation.

1 Claim, 8 Drawing Sheets

AUXILIARY TOOL CLIP OF A JACK

BACKGROUND OF THE INVENTION (a) Field of the Invention

The present invention relates to an auxiliary tool clip of a jack, wherein one predetermined position of a shroud of the jack is installed with a positioning seat. Thereby, an elastic clip is pivotally installed thereon; and thus the clip is used to clip a flashlight, or a tire pressure meter or other jack used auxiliary tool. Further the orientation of the clip is changeable through rotation.

(b) Description of the Prior Art

In using a jack, it is often that the illumination is weak because light is shielded by a heavy object (especially, as repairing a car). As a result, the user can see the top plate of the jack precisely. Not only the bottom of the heavy will be harmed, but also it is possible that the heavy object will fall down. Therefore, the operator is in a dangerous condition.

SUMMARY OF THE INVENTION

Accordingly, the primary object of the present invention is to provide an auxiliary tool clip of a jack, wherein one predetermined position of a shroud of the jack is installed with a positioning seat. Thereby, an elastic clip is pivotally installed thereon; and thus the clip is used to clip a flashlight, or a tire pressure meter or other jack used auxiliary tool and the orientation of the clip is changeable through rotation.

Another object of the present invention is to provide an auxiliary tool clip of a jack, wherein the positioning shaft penetrates through the elastic clip, positioning seat and shroud so as to be movably locked. A penetrating end of the positioning shaft is engaged with a spring and then is locked or riveted with a screw element.

A further object of the present invention is to provide an auxiliary tool clip of a jack, wherein any shroud of the jack can be pivotally installed to the elastic clip for clamping a flashlight or a tire pressure meter or other auxiliary tool of the jack. It can be rotated to change the angle of clamping or as it is used to clamp a flashlight, the illuminating direction can be adjusted so as to provide a sufficient illuminating light source.

The various objects and advantages of the present invention will be more readily understood from the following detailed description when read in conjunction with the appended drawing.

DETAILED DESCRIPTION OF THE PREFERRED EMBODIMENTS

Figure 1:
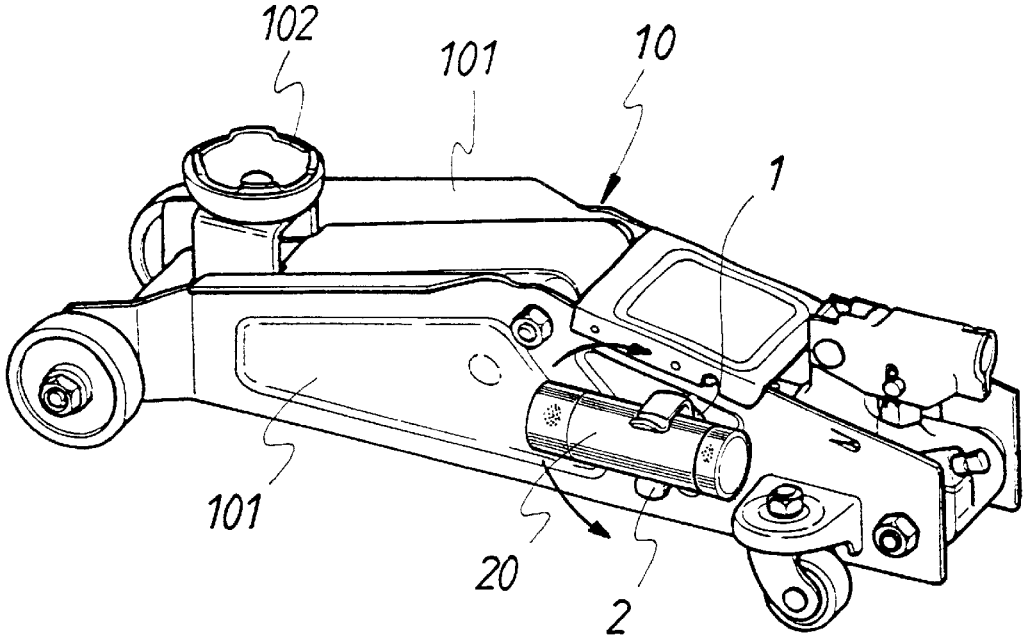
FIG. 1 is an assembled perspective view of the present invention which is combined with a flashlight and then is used in a jack.
Figure 2:
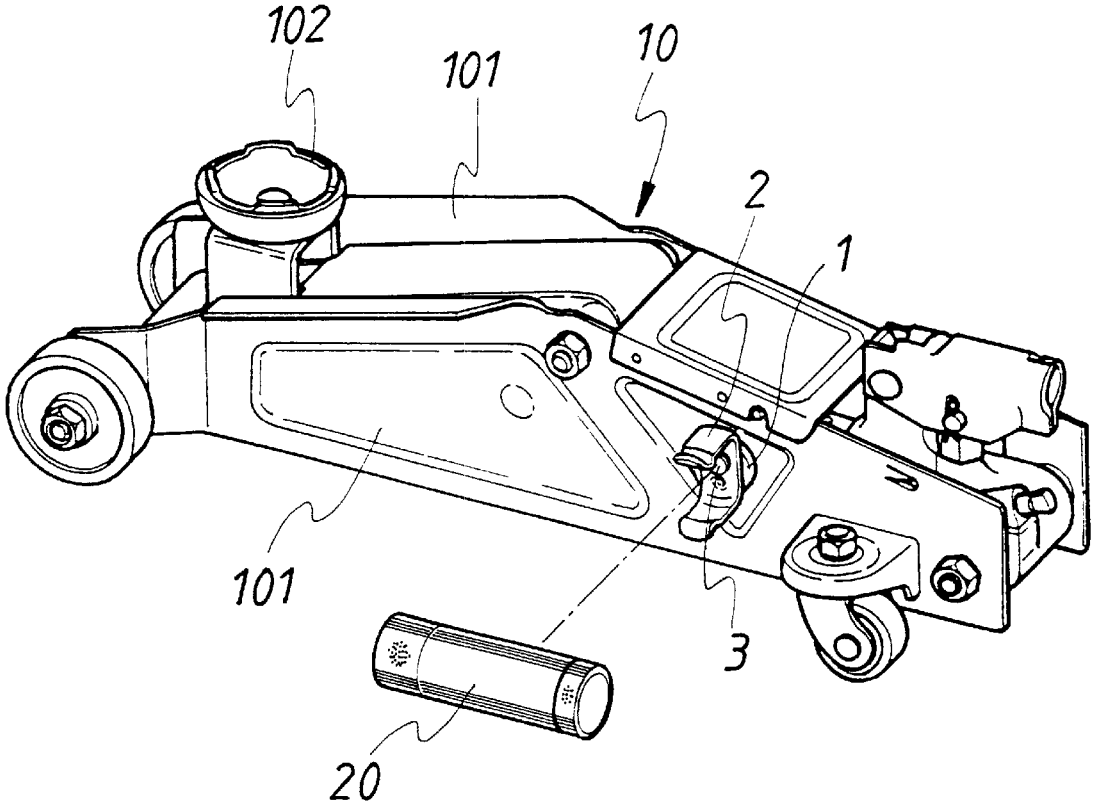
FIG. 2 is a schematic view of FIG. 1, wherein the flashlight is separated.
Figure 3:
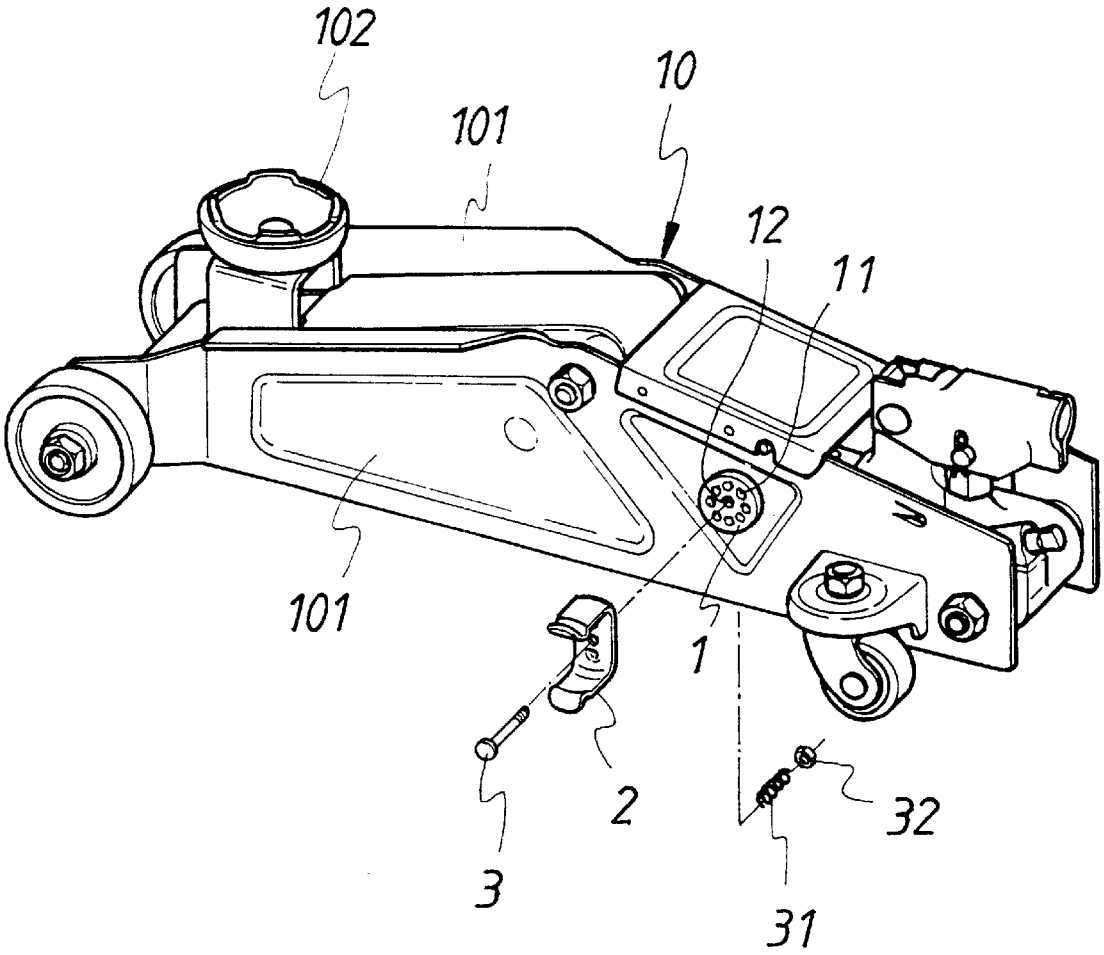
FIG. 3 is an exploded perspective view showing that the present invention is used to a jack.

Referring to FIGS. 1 and 3, the auxiliary tool clip of a jack of the present invention is illustrated. One predetermined position of a shroud 101 of the jack 10 is installed with a positioning seat 1. Thereby, an elastic clip 3 can be pivotally installed thereon. The elastic clip 2 penetrates through the positioning seat 1 and the shroud 101 by a positioning shaft 3.

The positioning seat is combined to a predetermined position of one shroud 101 of the jack 10. The way for combining the two is not confined in the present invention. For example, welding (as illustrated in the drawing), locking, punching, etc. can be used in the present invention. The surface of the positioning seat 1 is distributed with a plurality of positioning holes 11 and a center thereof is installed with a through hole 12.

The elastic clip 2 is a clamping element for clamping a predetermined tool, such as a flashlight, or other auxiliary tool. The bottom of the elastic clip 2 can be installed with at least one positioning nose 21. When the positioning nose 21 rotates. The positioning nose 21 may move along the plurality of positioning grooves 11 on the surface of the positioning seat 1.

Figure 5:
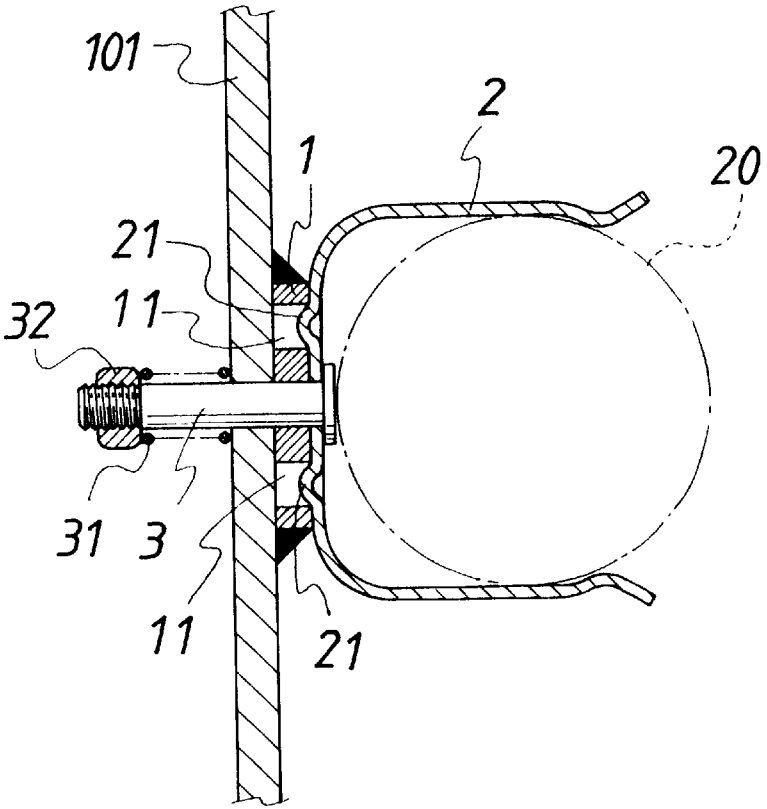
FIG. 5 is a partial schematic view showing that the present invention is locked to a shroud of a jack and a position nose is embedded into the positioning groove.
Figure 4:
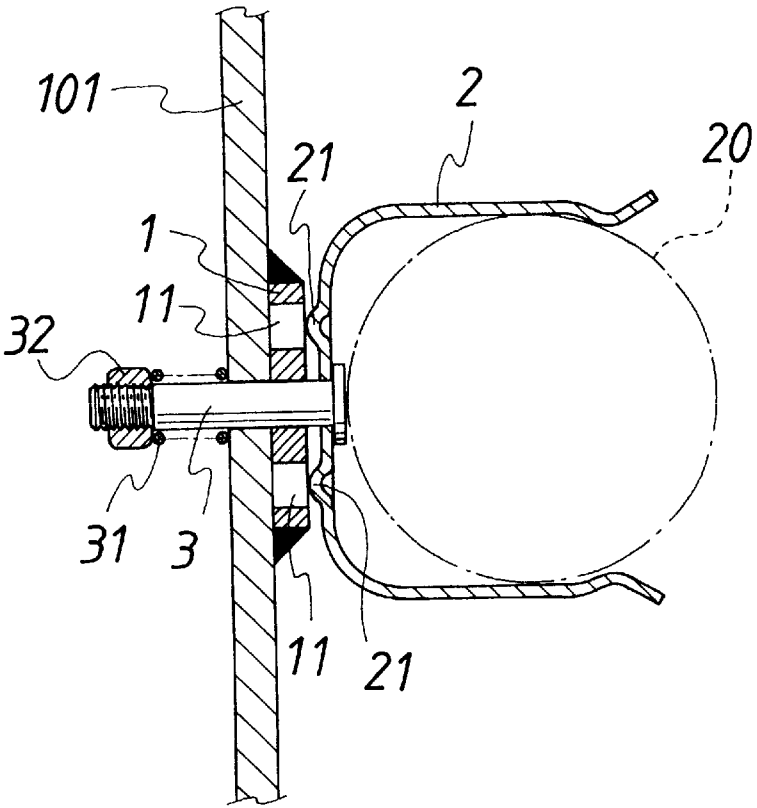
FIG. 4 is a partial schematic view showing that the present invention is locked to a shroud of a jack and a position nose is separated from the positioning groove.
Figure 6:
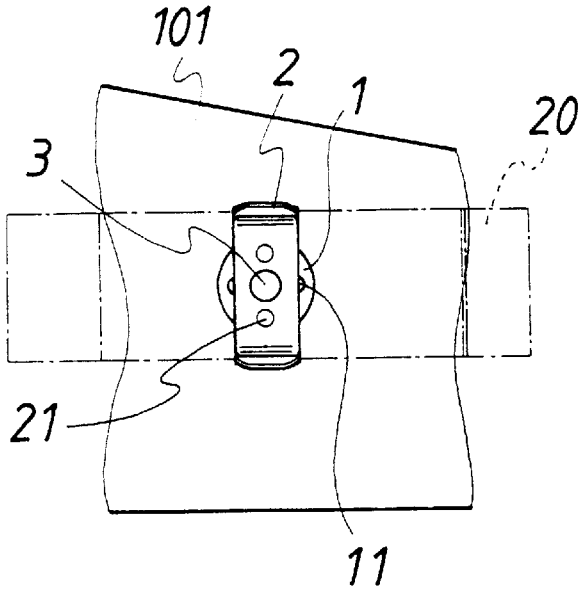
FIG. 6 is a schematic view showing that the present invention is horizontally combined with a flashlight.
Figure 7:
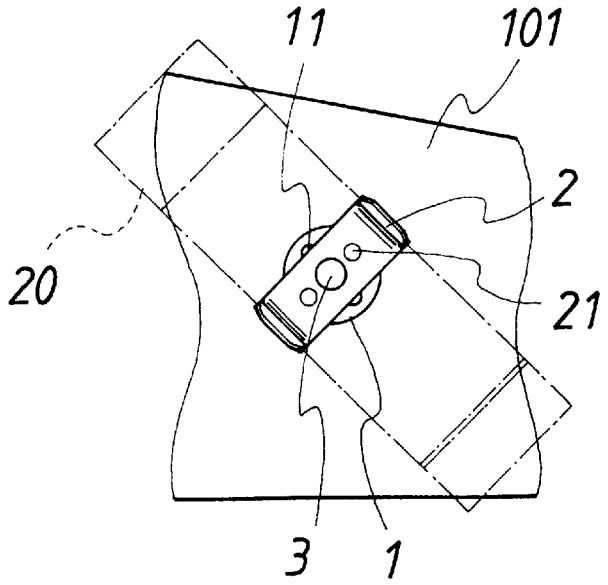
FIG. 7 is a schematic view showing that the present invention combined with a flashlight is changed in orientation.
Figure 8:
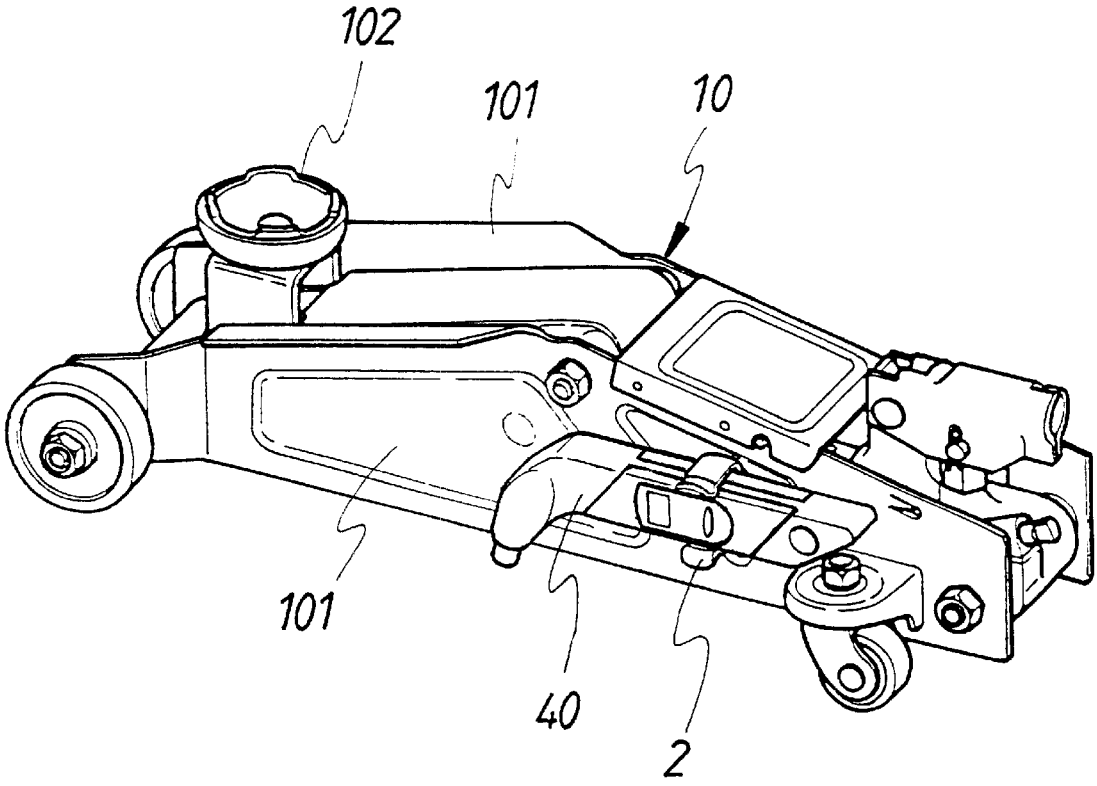
FIG. 8 is an assembled perspective view showing that the present invention is combined with a tire pressure meter and then is used to a jack.
Figure 9:
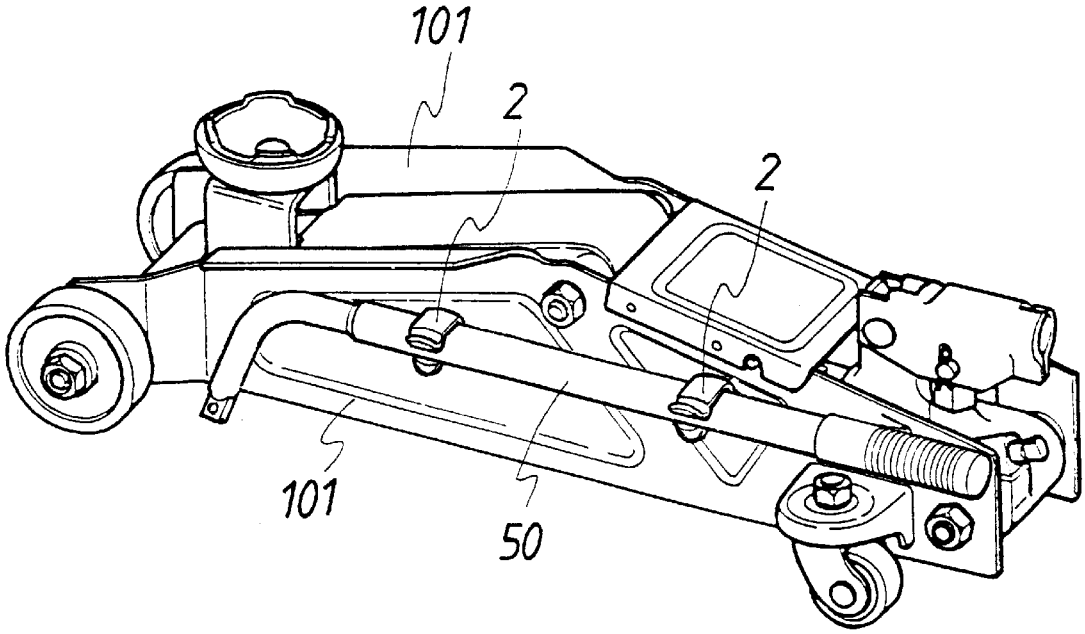
FIG. 9 is an assembled perspective view showing that the present invention is combined with a handle and then is used to a jack.

The positioning shaft 3 penetrates through the elastic clip 2, positioning seat 1 and shroud 101 so as to be movably locked. The penetrating end of the positioning shaft 3 is engaged with a spring 31 and then is locked or riveted with a screw element 32. The elastic clip 2 may be elastically combined with other object and thus the elastic clip 2 can be pulled outwards so that a positioning nose 21 is separated from the positioning holes 11 (referring to FIG. 4). Then it can be rotated and then restored to the original position (referring to FIG. 5). As a result, the clamp angle between the elastic clip 2 and the auxiliary tool (such as flashlight) can be adjusted as desired. In above components, any shroud 101 of the jack 10 can be pivotally installed to the elastic clip 2 for clamping a flashlight 20 or a tire pressure meter or other auxiliary tool of the jack. It can rotate to change the angle of clamping or as it is used to clamp a flashlight, the illuminating direction can be adjusted so as to provide a sufficient illuminating light source. Thereby, the user may clearly check the top disk 102 of the jack and the correcting ejecting position of a heavy object so as to assure a safe operation.

Figure 10:
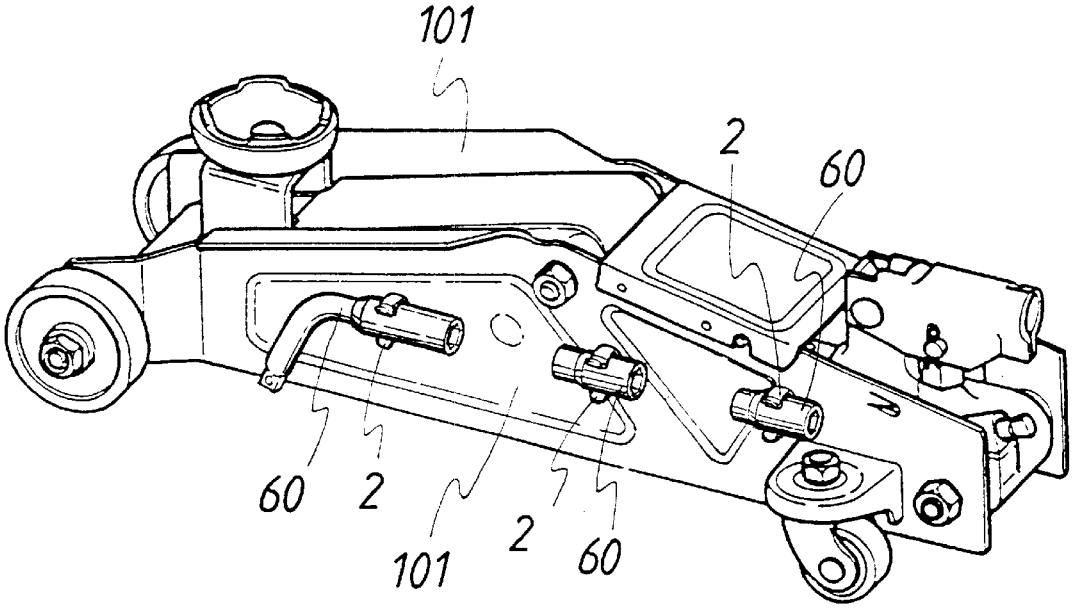
FIG. 10 is an assembled perspective view showing that the present invention is combined to a spanner sleeve and then is used to a jack.

Above said is only one example, but not used to confine the technology of the present invention. Other equivalent applications and modifications of above embodiment are within the scope and spirit of the present invention. For example, any one or two shrouds 101 of the jack 10 may be installed with a plurality of auxiliary tools for being used by a flashlight, a tire pressure meter 40, a handle, a spanner sleeve 60, etc. (referring to FIGS. 18 and 10). The number of the auxiliary tool is not confined in the present invention, it is determined as desired.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An auxiliary tool clip of a jack, wherein one predetermined position of a shroud of the jack is installed with a positioning seat;

an elastic clip is pivotally installed on the positioning seat, the clip is adapted to clip thereon a flashlight, a tire pressure meter or other auxiliary tool, and the orientation of the elastic clip is changeable through rotation;

the elastic clip is secured to the positioning seat and the shroud by a positioning shaft;

a surface of the positioning seat comprises a plurality of positioning holes positioned circumferentially around the positioning seat; and a bottom surface of the elastic clip includes at least one positioning nose such that when the positioning nose is rotated, the positioning nose moves into a corresponding one of the positioning holes on a corresponding surface of the positioning seat.

* * * * *